US009115551B2

(12) United States Patent
Kim et al.

(10) Patent No.: US 9,115,551 B2
(45) Date of Patent: Aug. 25, 2015

(54) REAMING SHELL FOR MINING

(75) Inventors: Ki-Ho Kim, Gyunggi-do (KR); Sung-Hoon Chung, Irvine, CA (US)

(73) Assignee: EHWA DIAMOND INDUSTRIAL CO., LTD., Gyunggi-Do (KR)

( * ) Notice: Subject to any disclaimer, the term of this patent is extended or adjusted under 35 U.S.C. 154(b) by 377 days.

(21) Appl. No.: 13/805,816

(22) PCT Filed: Feb. 21, 2011

(86) PCT No.: PCT/KR2011/001112
§ 371 (c)(1),
(2), (4) Date: Dec. 20, 2012

(87) PCT Pub. No.: WO2012/115287
PCT Pub. Date: Aug. 30, 2012

(65) Prior Publication Data
US 2013/0087390 A1 Apr. 11, 2013

(51) Int. Cl.
*E21B 10/26* (2006.01)
*E21B 10/02* (2006.01)
*E21B 10/60* (2006.01)

(52) U.S. Cl.
CPC ..... *E21B 10/26* (2013.01); *E21B 10/02* (2013.01); *E21B 10/60* (2013.01)

(58) Field of Classification Search
USPC ..... 175/387, 324
See application file for complete search history.

(56) References Cited

U.S. PATENT DOCUMENTS

| | | | | |
|---|---|---|---|---|
| 3,833,077 | A * | 9/1974 | Lavallee | 175/325.2 |
| 4,385,669 | A * | 5/1983 | Knutsen | 175/323 |
| 4,512,425 | A * | 4/1985 | Brock | 175/430 |
| 2007/0289782 | A1 | 12/2007 | Clark | |
| 2008/0142262 | A1 * | 6/2008 | Drivdahl et al. | 175/20 |
| 2008/0296066 | A1 | 12/2008 | Putnam | |
| 2009/0283328 | A1 | 11/2009 | Drivdahl | |
| 2010/0051349 | A1 * | 3/2010 | Ballard et al. | 175/57 |
| 2012/0061146 | A1 * | 3/2012 | Pearce et al. | 175/58 |

FOREIGN PATENT DOCUMENTS

KR 10-2005-0095325 9/2005

OTHER PUBLICATIONS

International Search Report for corresponding patent application PCT/KR2011/001112 dated Oct. 6, 2011.
Written Opinion for corresponding patent application PCT/KR2011/001112 dated Oct. 6, 2011.

* cited by examiner

*Primary Examiner* — David Andrews
*Assistant Examiner* — Kyle Armstrong
(74) *Attorney, Agent, or Firm* — Renner, Otto, Boisselle & Sklar, LLP

(57) ABSTRACT

A reaming shell for mining is provided. The reaming shell has a shank, and a plurality of pads attached at circumferential intervals from each other to extend lengthwise on an outer periphery of the shank. The reaming shell is coupled to a core bit of a diamond drilling tool for mining. The reaming shell includes a water groove of a recessed shape formed respectively between each adjacent pair of the pads, and extending from a leading edge along a length of the shank.

4 Claims, 3 Drawing Sheets

REAMING SHELL FOR MINING

This application is a national phase of International Application No. PCT/KR2011/001112 filed Feb. 21, 2011 and published in the English language.

TECHNICAL FIELD

The present invention relates to a reaming shell for mining used on a diamond tool for mining drilling, and more particularly, to a reaming shell for mining with an extended service life.

BACKGROUND ART

A diamond drilling tool for mining is a tool that is used to bore several tens to several thousands of meters into the ground to extract a core sample (a cylindrical sample taken lengthwise from drilled bedrock), in order to check the distribution or buried quantity of useful minerals in the ground.

As shown in FIG. 1, a diamond drilling tool 1 for mining can be largely divided into a core bit 10 and a reaming shell 20, where the core bit 10 is a tool that directly contacts bedrock containing minerals to excavate (drill) the bedrock, and the reaming shell 20 is a tool connected directly to the rear of the core bit 10 to perform a finishing operation on the uneven portions of the bedrock drilled by the core bit 10 to make the gauge of the bedrock uniform.

When a diamond drilling tool for mining is used for excavating bedrock, it is very important to maintain a uniform hole diameter of the bored bedrock (the function of a reaming shell), because if the bored diameter of the bedrock is not uniform along its length from the tip to the mining drilling machine on the ground surface connected by pipes (drilling rods supplied with cooling water), the pipes connected in between are prone to be damaged, and the excavating speed (drilling speed and cutting ability) are affected.

Therefore, the function of the reaming shell that maintains hole diameter during drilling is very important, and the durability of the reaming shell determines how long the hole diameter can be uniformly maintained during drilling.

An example of a related art reaming shell is shown in FIG. 2, where a large quantity of cooling water supplied to the core bit 10 during drilling is supplied within the core bit 10 that performs the excavation, through a pipe (drilling rod), after which bedrock particles cut by the core bit 10 are externally discharged with the water.

The thus-discharged drilling sludge (cooling water+bedrock particles) is discharged toward the reaming shell whose outer periphery with a water way between one pad 21 and another pad 21 is substantially the same as the outer periphery of the shank 201, so that the drilling sludge cannot easily be discharged.

Thus, drilling sludge is not easily discharged with a related art reaming shell, inducing the formation of drilling slurry vortices at the leading edge 23 of the reaming shell 20, leading to localized wear and resultant early wear or separation of grinding material 211, and ultimately causing the inability to maintain hole diameter uniformity and a significant reduction in service life.

DISCLOSURE OF INVENTION

Technical Problem

An aspect of the present invention provides a reaming shell for mining that effectively discharges cooling water to improve the service life thereof.

Solution to Problem

According to an aspect of the present invention, there is provided a reaming shell for mining, of the type having a shank, and a plurality of pads attached at circumferential intervals from each other to extend lengthwise on an outer periphery of the shank, the reaming shell coupled to a core bit of a diamond drilling tool for mining, wherein the reaming shell includes a water groove of a recessed shape formed respectively between each adjacent pair of the pads, and extending from a leading edge along a length of the shank.

The water groove may include: a front portion having a depth with a negative (−) sloped angle, which becomes deeper rearward; a middle portion that is substantially flat; and a rear portion having a depth with a positive (+) sloped angle, which becomes shallower rearward.

The sloped angle of the front portion of the water groove may range from about −3° to about −10°.

The rear portion of the water groove may be formed having a groove line configuration with a positive (+) sloped angle, to easily discharge drilling slurry (cooling water+bedrock particles).

Here, the front portion and rear portion of the water groove are defined in terms of a bedrock drilling direction, such that the front portion corresponds to a front and the rear portion corresponds to a rear of the bedrock drilling direction.

Advantageous Effects of Invention

As described above, a reaming shell with a prolonged service life is provided that can be widely applied in general drilling operations.

BRIEF DESCRIPTION OF DRAWINGS

The above and other aspects, features and other advantages of the present invention will be more clearly understood from the following detailed description taken in conjunction with the accompanying drawings, in which.

BEST MODE FOR CARRYING OUT THE INVENTION

Exemplary embodiments of the present invention will now be described in detail with reference to the accompanying drawings.

Figure 1:
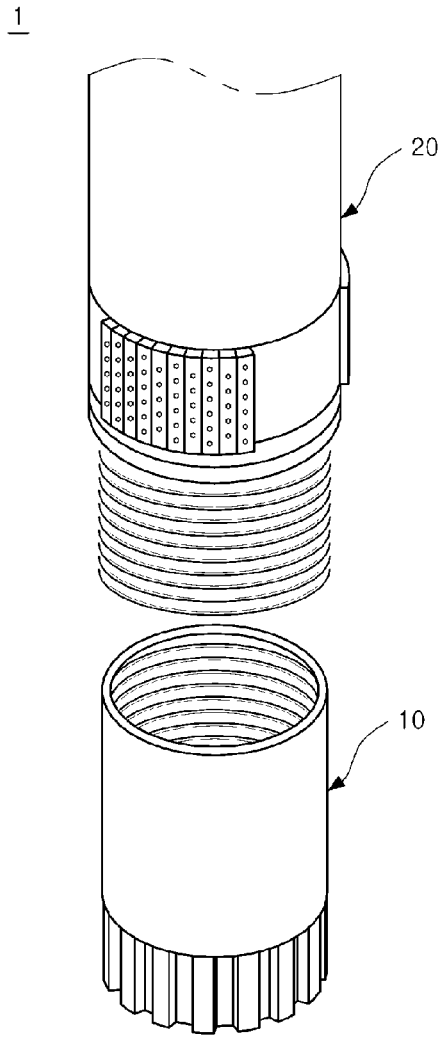
FIG. 1 is a schematic view of an example of a diamond tool for mining according to the related art.
Figure 2:
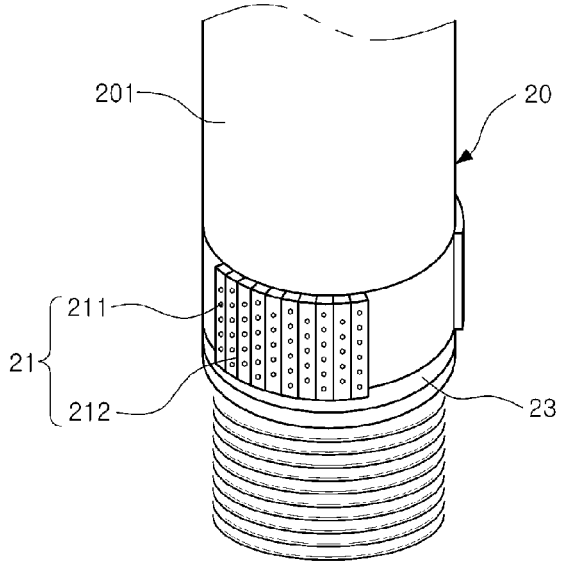
FIG. 2 is a schematic view of a mining reaming shell of a diamond tool for mining according to the related art.
Figure 3:
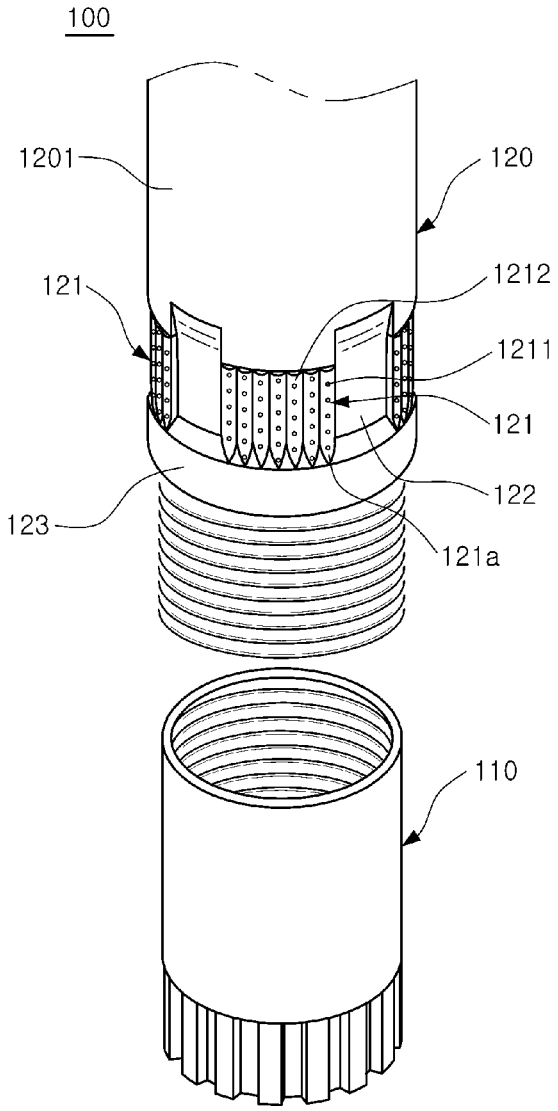
FIG. 3 is a schematic view of a reaming shell for mining according an embodiment of the present invention.

FIG. 3 is a schematic view of a reaming shell for mining according an embodiment of the present invention.

Referring to FIG. 3, a reaming shell 120 according to the present invention is coupled to a core bit 110 of a diamond drilling tool 100.

The reaming shell 120 includes a shank 1201, and a plurality of pads 121 are attached at circumferential intervals from each other to extend lengthwise on the outer periphery of the shank 1201.

Water grooves 122 are defined between one pad 121 and another pad 121, and the water groove portions are formed of metal couplers.

By defining the water grooves 122, drilling slurry (cooling water+bedrock particles) that exits the core bit 110 is easily discharged through the water grooves and does not generate vortices at the leading edge 123 of the reaming shell 120. Thus, wear of the metal couplers 1212 that hold grinding material 1211 may be prevented, and the service life of the reaming shell is prolonged.

The pad 121 may include, for example, grinding material 1211 such as diamond and metal couplers 1212 for holding the grinding material 1211, and the outer diameter of the pad 121 is greater than that of the shank 1201.

The pad 121 includes a plurality of broaches 121*a* that include the grinding material 1211.

The broaches 121*a* are formed linearly, and one pad 121 typically includes 5-8 lines of broaches 121*a*.

The water groove 122 is configured as a recess. That is, the outer diameter of the water grooves 122 is less than that of the shank 1201.

Figure 4:
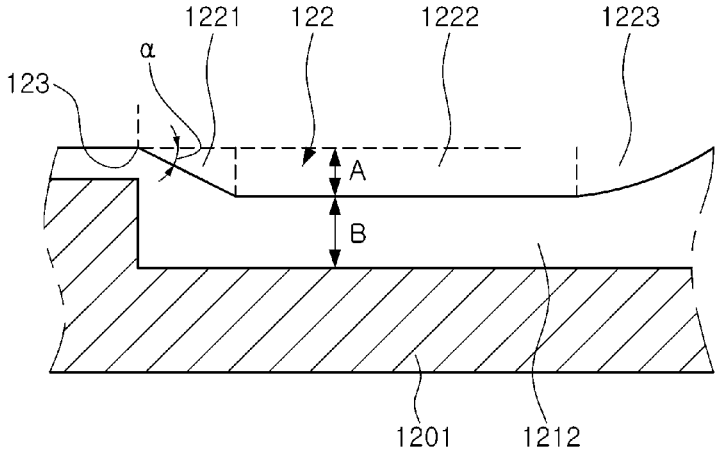
FIG. 4 is an enlarged sectional view of a water groove, a metal coupler, and a shank of a reaming shell for mining according to an embodiment of the present invention.

As shown in FIG. 4, the water groove 122 begins at a leading edge 123 and extends along the length of the shank.

The leading edge 123 is a reaming shell portion between a coupling portion (the rearmost end of the coupling portion) coupled to the core bit and the pads.

The reason that the water groove 122 begins at the leading edge 123 and extends along the length of the reaming shell is to prevent the formation of drilling slurry vortices at the leading edge 123 which makes discharge thereof difficult, resulting in wear on the pads that causes separation of grinding material and shortens service life of the reaming shell.

The present inventor has confirmed the above through extended research and direct personal experience.

The water groove may include a front portion 1221 with a depth having a negative (−) sloped angle (α) that becomes deeper rearward, a middle portion 1222 that is almost flat, and a rear portion 1223 with a depth having a positive (+) sloped angle that becomes shallower rearward.

The sloped angle (α) of the front portion 1221 of the water groove may have a slope of about −3° to about −10°.

Here, the sloped angle (α) having a negative (−) value denotes that the depth increases rearward The reason that the front portion 1221 may have a sloped angle (α) of about −3° to about −10° is that if the sloped angle (α) is greater than −3° (−2°, for example), it will have little effect in improving drilling slurry discharge, and if it is less than −10° (−11°, for example), it will greatly increase wear within the water groove, making the desired effects difficult to obtain.

The difference (the depth of the water groove) A between the outer circumference of the water groove at the middle portion of the water groove and the outer circumference of the shank may be about 0.7 to about 2.2 mm, the reason being that if the depth A of the water groove is too shallow, discharge of drilling slurry will be difficult, and if the depth is too great, the thickness B of the metal couplers will be excessively reduced, so that following sintering, the frequency of defect occurrence (in which the metal couplers peel off and shape defects arise from a sanding process for plating, for example) increases. Also, if the depth is too great, even a small amount of wear that occurs by means of the drilling slurry during actual drilling can cause exposure of the shank, resulting in reduced service life.

The thickness of the metal couplers at the middle portion of the water groove may be about 2.1 mm to about 4.0 mm.

If the metal couplers are too thin, the frequency of defect occurrence such as defects following sintering increases, and the shank is easily exposed with a small amount of wear, so that service life is reduced.

The rear portion 1223 of the water groove may be formed in a curvature of a positive (+) sloped angle, in order to facilitate discharge of drilling slurry that enters the water groove 122 out from the water groove 122.

A description will be provided of a preferred example of a method for manufacturing the reaming shell according to the present invention.

Figure 5:
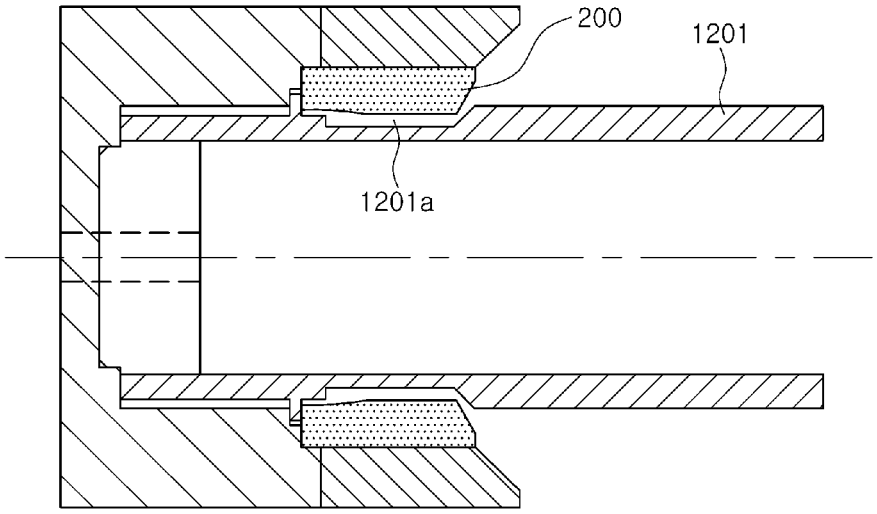
FIG. 5 is a schematic view showing a carbon mold positioned at the periphery of a shank when manufacturing a reaming shell according to an embodiment of the present invention.

To manufacture a reaming shell according to an embodiment of the present invention, as shown in FIG. 5, a shank 1201 is processed to have an outer periphery of a certain depth where pads are to be attached, and carbon molds 200 are prepared in the desired shape of the pads and for forming the water grooves.

Next, grinding material is bonded to the carbon molds 200 in the desired pad form with an adhesive, etc., after which the carbon molds 200 are positioned at certain intervals apart on the shank portion 1201*a* processed as above.

The carbon molds 200 are positioned such that a portion thereof is disposed in the processed portion, so that water grooves are formed having an outer circumference less than that of the shank.

The portions of the carbon molds forming the pads are processed such that the outer circumference of the pads is greater than that of the shank (not shown).

Figure 6:
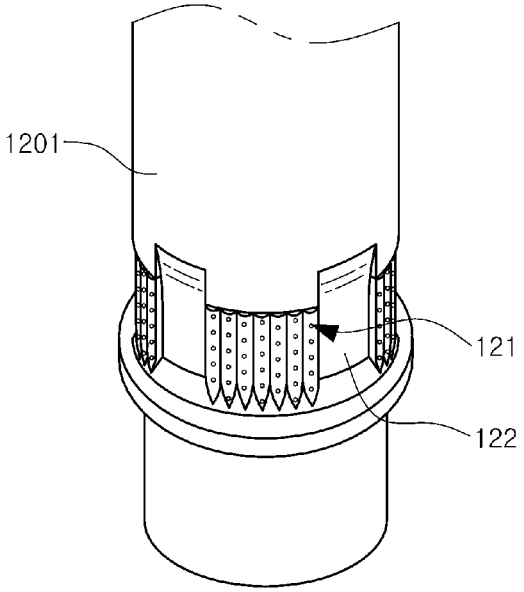
FIG. 6 is a schematic view of a pad and water groove after sintering in the manufacture of a reaming shell according to an embodiment of the present invention.

Next, the metal couplers are filled between the shank portion and the carbon molds, after which the assembly is heated and sintered to melt the low melting point metal couplers to be fused into and between the shank portion and the carbon molds. Then, as shown in FIG. 6, the carbon molds are removed to yield the sintered pads 121 attached to the outer periphery of the shank 1201 and water grooves 122 formed between pairs of adjacent pads.

After the metal couplers are filled between the processed shank portion 1201*a* and the carbon molds 200, heating and sintering are performed to remove the grinding material (that was attached by the adhesive, etc. to the carbon molds) from the carbon molds and fix them by means of the metal couplers.

The outer circumference of the pad portion is greater than that of the shank, and the outer circumference of the water groove portion is less than that of the shank.

The rear portions of the water grooves are formed to have curved shapes.

The manufacturing method provided is but one example, and the manufacturing method of a reaming shell according to the present invention is not limited thereto.

Below, the present invention will be described in further detail through an example.

EXAMPLE

After the reaming shell (the invented material) defining water grooves, and a related art reaming shell (pads, where the outer circumference of the pads and that of the shank between the pads are substantially the same) (the related art material) were respectively coupled to a core bit, a general drilling operation was performed, and the service life of the reaming shell was measured. The results are shown in Table 1 below. Service life is indicated in terms of drill length (m).

TABLE 1

| Test Region and Specs | Related Art Material | Invented Material |
|---|---|---|
| N. America, Reaming Shell (NQ) | 600 (m) | 900 (m) |

As can be seen from the above table, the invented material compared to the related art material has a service life improved by 30%.

While the present invention has been shown and described in connection with the exemplary embodiments, it will be apparent to those skilled in the art that modifications and variations can be made without departing from the spirit and scope of the invention as defined by the appended claims.

The invention claimed is:

1. A reaming shell for mining, of the type having a shank having an axially forward end and an axially rearward end, and a plurality of pads attached at circumferential intervals from each other to extend lengthwise on an outer periphery of the shank, the reaming shell being configured for coupling at its axially forward end to a core bit of a diamond drilling tool for mining, wherein the reaming shell comprises a water groove between an adjacent pair of the pads, the water groove extending axially from a leading edge along a length of the shank, and wherein the water groove has an axially forward portion having a depth with a negative (−) sloped angle, which becomes deeper going from an axially forward end of the axially forward portion toward a rearward end of the axial forward portion, a middle portion that is substantially flat, and an axially rearward portion having a depth with a positive (+) sloped angle, which becomes shallower going from an axially forward end of the axially rearward portion to an axially rearward end of the axially rearward portion.

2. The reaming shell for mining of claim 1, wherein the sloped angle of the front portion of the water groove ranges from about −3° to about −10°.

3. The reaming shell for mining of claim 1, wherein the difference between an outer circumference of the water groove at the middle portion of the water groove and an outer circumference of the shank ranges from about 0.7 mm to about 2.2 mm and is the depth of the water groove.

4. The reaming shell for mining of claim 2, wherein the difference between an outer circumference of the water groove at the middle portion of the water groove and an outer circumference of the shank ranges from about 0.7 mm to about 2.2 mm and is the depth of the water groove.

* * * * *